US008928565B2

(12) United States Patent
Chiu et al.

(10) Patent No.: US 8,928,565 B2
(45) Date of Patent: Jan. 6, 2015

(54) METHOD AND DEVICE FOR DRIVING AN OLED PANEL

(75) Inventors: Chun-Chieh Chiu, Taoyuan County (TW); Shih-Meng Chang, New Taipei (TW); Chien-Hung Chen, Taipei County (TW)

(73) Assignee: Chunghwa Picture Tubes, Ltd., Taoyuan (TW)

( * ) Notice: Subject to any disclaimer, the term of this patent is extended or adjusted under 35 U.S.C. 154(b) by 197 days.

(21) Appl. No.: 13/602,854

(22) Filed: Sep. 4, 2012

(65) Prior Publication Data

US 2013/0235013 A1 Sep. 12, 2013

(30) Foreign Application Priority Data

Mar. 6, 2012 (TW) ..... 101107442 A

(51) Int. Cl.
*G09G 3/30* (2006.01)

(52) U.S. Cl.
USPC ..... 345/77; 345/83

(58) Field of Classification Search
CPC ..... G09G 2330/021
USPC ..... 345/76–77, 82–83; 315/169.3
See application file for complete search history.

(56) References Cited

U.S. PATENT DOCUMENTS

| | | | | |
|---|---|---|---|---|
| 6,380,943 | B1 * | 4/2002 | Morita et al. | 345/589 |
| 8,522,059 | B2 * | 8/2013 | Jeansonne et al. | 713/320 |
| 2006/0044230 | A1 * | 3/2006 | Eom | 345/76 |
| 2012/0044274 | A1 * | 2/2012 | Lee et al. | 345/690 |

FOREIGN PATENT DOCUMENTS

| | | | |
|---|---|---|---|
| CN | 1841478 | | 10/2006 |
| JP | 2002251167 | A | 9/2002 |
| TW | 200948096 | A | 11/2009 |

* cited by examiner

*Primary Examiner* — Chanh Nguyen
*Assistant Examiner* — Roy Rabindranath
(74) *Attorney, Agent, or Firm* — Muncy, Geissler, Olds & Lowe, P.C.

(57) ABSTRACT

A method for driving an OLED panel includes the following steps. An image signal is inputted to a power control unit, wherein the power control unit includes a calculator and a power control look-up table. A display loading ratio is calculated by the calculator according to the image signal, wherein the power control unit can find an emitting time ratio by the power control look-up table corresponding to the display loading ratio, the emitting time ratio can be transformed to an emitting time signal, and the emitting time signal can be inputted to the OLED panel so as to control the power consumption of the OLED panel.

9 Claims, 4 Drawing Sheets

METHOD AND DEVICE FOR DRIVING AN OLED PANEL

CROSS-REFERENCE TO RELATED APPLICATION

This application claims the benefit of Taiwan Patent Application No. 101107442, filed on Mar. 6, 2012, which is hereby incorporated by reference for all purposes as if fully set forth herein.

BACKGROUND OF THE INVENTION

1. Field of Invention

This invention relates to a method and a device for driving an organic light emitting diode (OLED) panel, and more particularly to a driving method and a driving device for controlling an emitting time of an OLED panel.

2. Related Art

An organic light emitting diode (OLED) panel is better than other flat panel, and has many advantages of lower power consumption, high brightness, easy manufacture, etc., for example.

When the OLED panel is applied to a portable or handheld electronic product, such as cell phone, digital camera, digital camcorder, etc., components of the electronic product generally has an important requirement of property, i.e. lower power consumption. Thus, a vendor of the electronic product generally requests that these components must be operated within a range of regular power consumption. According to a display device of the self-emitting type OLED panel, for example, the power consumption of the OLED panel must be less than the regular value certainly, when the OLED panel displays any image of the picture frame.

The prior art discloses a solution that: when a current of the power supply of the OLED panel is detected, the gray-level of the picture is lowered if the detected current is more than a rated value, whereby a voltage of the power supply of the OLED panel is decreased so as to cause the OLED panel to be operated within the range of regular power consumption.

However, disadvantages of the above-mentioned solution are to decrease resolution of the real gray-level and to generate the problem of the dither noise and the flash of frame rate control (FRC).

Accordingly, there exists a need for a method for driving an OLED panel capable of solving the above-mentioned problems.

SUMMARY OF THE INVENTION

It is one object of the present invention to control the emitting time of an OLED panel so as to control the power consumption.

The present invention provides a method for driving an OLED panel includes the following steps. An image signal is inputted to a power control unit, wherein the power control unit includes a calculator and a power control look-up table. A display loading ratio is calculated by the calculator according to the image signal, wherein the power control unit can find an emitting time ratio by the power control look-up table corresponding to the display loading ratio, the emitting time ratio can be transformed to an emitting time signal, and the emitting time signal can be inputted to the OLED panel so as to control the power consumption of the OLED panel.

The present invention further provides a driving device of an OLED panel including an image signal output unit and a power control unit. The image signal output unit is adapted to output the image signal. The power control unit is electrically connected to the image signal output unit for receiving the image signal, wherein the power control unit comprises a calculator and a power control look-up table, the calculator is adapted to calculate a display loading ratio according to the image signal, the power control unit finds an emitting time ratio by the power control look-up table corresponding to the display loading ratio, the emitting time ratio is transformed to an emitting time signal, and the emitting time signal is inputted to the emitting control lines of the OLED panel so as to control the power consumption of the OLED panel.

Thus, the present invention utilizes the emitting control lines to control the emitting time of the OLED panel, and then control the power consumption so as to improve the lifetime of the OLED panel and to keep the resolution of the same gray-level. The present invention can indirectly improve the quality of motion blur image, and has no problem of the dither noise and the flash of frame rate control (FRC) in the prior art.

In order to make the aforementioned and other objectives, features and advantages of the present invention comprehensible, embodiments are described in detail below with reference to the accompanying drawings.

BRIEF DESCRIPTION OF THE DRAWINGS

The present invention will become more fully understood from the detailed description given herein below for illustration only, and thus are not limitative of the present invention, and wherein.

DETAILED DESCRIPTION OF THE INVENTION

Figure 1:
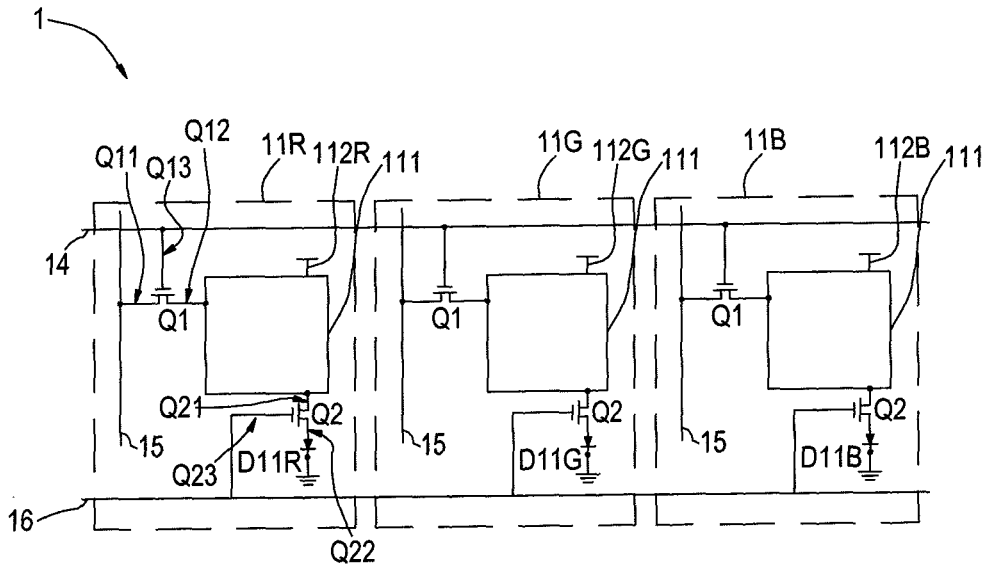
FIG. 1 is a circuit diagram of an organic light emitting diode (OLED) panel according to an embodiment of the present invention.

FIG. 1 is a circuit diagram of an organic light emitting diode (OLED) panel according to an embodiment of the present invention. The OLED panel 1 includes a plurality of data lines 15, scan lines 14, emitting control lines 16, red regions 11R, green regions 11G and blue regions 11B. In order to be easily described, FIG. 1 only shows three data lines 15, one scan line 14, one emitting control line 16, one red region 11R, one green region 11G and one blue region 11B. Each region (i.e., pixel region) of the red regions 11R, green regions 11G and blue regions 11B includes a pixel circuit 111, a first thin film transistor (TFT) Q1, a second thin film transistor (TFT) Q2 and an organic light emitting diode (OLED) D11R, D11G or D11B. A first end Q11 of the first TFT Q1 of each region is electrically connected to the corresponding data line 15, a second end Q12 is electrically connected to the pixel circuit 111, and a control end Q13 is electrically connected to the scan line 14. The data line 15, the scan line 14 and the first TFT Q1 control a gray-level value of the corresponding region, and the gray-level value is stored by the pixel circuit 111 located in the same region. A first end Q21 of the second TFT Q2 is electrically connected to the pixel circuit 111, a second end Q22 is electrically connected to the OLED D11R, D11G or D11B, and a control end Q23 is electrically connected to the emitting control line 16. Each pixel circuit 111 has an operating voltage 112R, 112G or 112B for providing the pixel circuit 111 with a voltage signal. The emitting control line 16 controls whether the OLED D11R, D11G or D11B is lighted, and the emitting time of the OLED panel 1.

Figure 2:
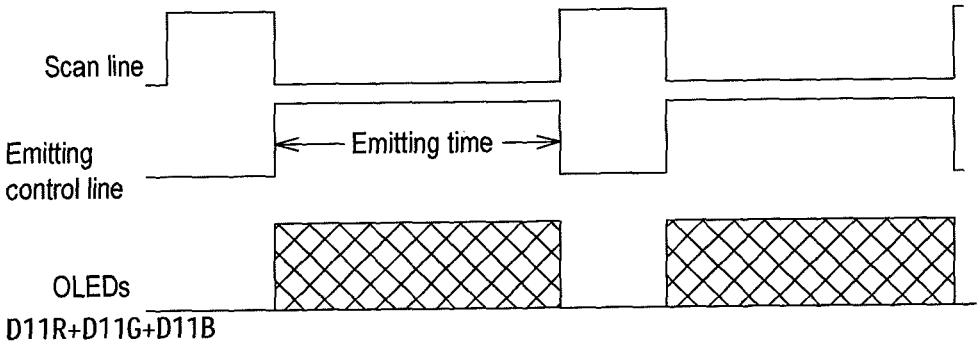
FIG. 2 is a schematic view showing timings of signals of the scan line, the emitting control line and the OLED according to the embodiment of the present invention.

FIG. 2 shows timings of signals of the scan line, the emitting control line and the OLED. Referring to FIGS. 2 and 1, the first TFT Q1 is switched on when the scan line 14 has a high level signal, whereby an image signals is inputted from the data line 15 to the corresponding pixel circuits 111. At the moment, the emitting control line 16 and the OLEDs D11R, D11G and D11B are switched off. The emitting control line 16 has a high level signal, and the second TFT Q2 is switched on when the scan line 14 is switched off, whereby the OLEDs D11R, D11G and D11B are electrically connected to the corresponding pixel circuits 111 respectively, and are lighted by signals of the corresponding pixel circuits 111. The gray-level of the OLEDs D11R, D11G and D11B are provided by the corresponding pixel circuits 111. The keeping time of the high level signal of the emitting control line 16 is an emitting time of the OLED panel 1.

Figure 3A:
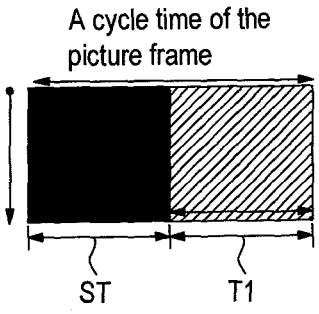
FIG. 3*a* is a schematic view showing a cycle time of the picture frame is equal to the scan time plus the emitting time according to the embodiment of the present invention.

Referring to FIGS. 3*a* and 1, a scan time ST is defined by the time that the scan lines 14 scans the entire picture frame once, and an emitting time T1 is defined by the time that the OLEDs D11R, D11G and D11B are lighted, wherein a cycle time of the picture frame is equal to the scan time ST plus the emitting time T1. Referring to FIG. 3*a* again, after the scan lines 14 scans the entire picture frame once, the OLEDs D11R, D11G and D11B are lighted by the emitting control line 16 immediately. The OLEDs D11R, D11G and D11B are lighted until the cycle time of the picture frame is finished. The above-mentioned emitting time T1 is a maximal emitting time.

Figure 3B:
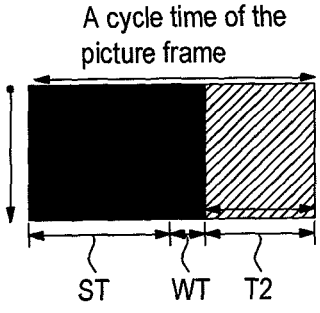
FIG. 3*b* is a schematic view showing a cycle time of the picture frame is equal to the scan time plus the emitting time and the waiting time according to the embodiment of the present invention.

Referring to FIGS. 3*b* and 1, a scan time ST is defined by the time that the scan lines 14 scans the entire picture frame once, and an emitting time T2 is defined by the time that the OLEDs D11R, D11G and D11B are lighted, a waiting time WT is defined by time that the scan time ST is finished and the OLEDs D11R, D11G and D11B are not lighted, wherein a cycle time of the picture frame is equal to the scan time ST plus the emitting time T2 and the waiting time WT. Referring to FIG. 3*b* again, after the scan lines 14 scans the entire picture frame once, the OLEDs D11R, D11G and D11B are only lighted by the emitting control line 16 after the waiting time WT. The OLEDs D11R, D11G and D11B are lighted until the cycle time of the picture frame is finished. The above-mentioned emitting time T2 is a real emitting time.

The emitting control line 16 of the present invention can control the power consumption, and the power consumption is low when the emitting time is low. An emitting time ratio Duty % is calculated as follows:

$$\text{Duty }\% = (T2/T1)\times 100\% \qquad \text{formula A,}$$

wherein: Duty % is the emitting time ratio, T1 is the maximal emitting time, and T2 is the real emitting time.

Figure 4:
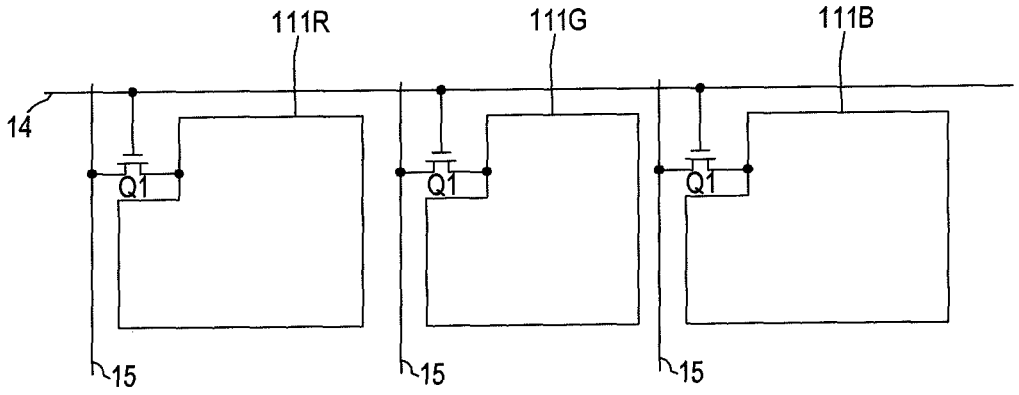
FIG. 4 is a schematic view showing pixel areas of the pixel regions of the OLED panel according to the embodiment of the present invention.

The present invention utilizes display loading values to calculate original power consumption of the current picture frame as follows:

$$\text{display loading value} = \left(k_{red}\times\sum_{i=1}^{n}\text{Red Gray Level} + k_{green}\times\sum_{i=1}^{n}\text{Green Gray Level} + k_{blue}\times\sum_{i=1}^{n}\text{Blue Gray Level}\right), \qquad \text{formula B}$$

wherein parameters are described as follows (refer to FIGS. 1 and 4):

display loading value: shows a loading when the picture frame of the OLED panel 1 is lighted;

$k_{red}$: is a coefficient which is corresponding to a pixel area 111R of the red region 11R of the OLED panel 1 and the operating voltage 112R;

$k_{green}$: is a coefficient which is corresponding to a pixel area 111G of the green region 11G of the OLED panel 1 and the operating voltage 112G;

$k_{blue}$: is a coefficient which is corresponding to a pixel area 111B of the blue region 11B of the OLED panel 1 and the operating voltage 112B;

$$\sum_{i=1}^{n}\text{Red Gray Level;}$$

is a sum of the gray-level values of all red regions 11R in the picture frame;

$$\sum_{i=1}^{n}\text{Green Gray Level:}$$

is a sum of the gray-level values of all green regions 11G in the picture frame; and $$\sum_{i=1}^{n}\text{Blue Gray Level:}$$

is a sum of the gray-level values of all blue regions 11B in the picture frame.

For example, according to conditions of the OLED panel, e.g., the relation between the display loading ratio and the emitting time ratio Duty %, a power control look-up table can be designed. The conditions of the used OLED panel are supposed as follows:

(1) the resolution is 640×480 resolution;

(2) the pixel area 111R of the red region 11R=the pixel area 111G of the green region 11G=the pixel area 111B of the blue region 11B;

(3) the operating voltage 112R of the red region 11R=the operating voltage 112G of the green region 11G=the operating voltage 112B of the blue region 11B;

(4) the power consumption of the highest gray-level value of the red region 11R=the power consumption of the highest gray-level value of the green region 11G=the power consumption of the highest gray-level value of the blue region 11B;

(5) the maximal power consumption of the OLED panel 1=the power consumption of the highest gray-level value of the red region 11R+the power consumption of the highest gray-level value of the green region 11G+the power consumption of the highest gray-level value of the blue region 11B=100 W (i.e., the maximal power consumption is 100 W when Duty % is 100%);

(6) the minimal power consumption of the OLED panel 1=the power consumption of the lowest gray-level value of the red region 11R+the power consumption of the lowest gray-level value of the green region 11G+the power consumption of the lowest gray-level value of the blue region 11B=10 W (i.e., the minimal power consumption is 10 W and is called as a black power, when Duty % is 100%); and (7) the emitting time is controlled by the emitting control line so as to cause the maximal power consumption being merely 25 W and then to define 25 W as a rated power consumption.

According to the above-mentioned conditions, we know that $k_{red}=k_{green}\ k_{blue}=1$, and the display loading values of different picture frames can be calculated by the formula B as follows:

the maximal display loading value of the full picture frame: $W_{Gray255}=R(640\times480\times255)+G(640\times480\times255)+B(640\times480\times255)\approx235\times10^6$; and the minimal display loading value of the full picture frame: $W_{Gray000}=R(640\times480\times0)+G(640\times480\times0)+B(640\times480\times0)=0$.

The maximal and minimal display loading values are normalized, the maximal display loading value is set to 1, i.e., $W_{Gray255}=100\%$ (the original power consumption is 100 W and is the maximal power consumption, too), and the minimal display loading value is set to 0, i.e., $W_{Gray000}=0\%$ (the original power consumption is 10 W and is the minimal power consumption, too).

It is supposed that the emitting time ratio Duty % is linearly proportional to the power consumption. When the original power consumption is more than the rated power consumption, the emitting time ratio Duty % can be calculated to be adjusted by the following formula:

Duty %=[(the rated power consumption−the minimal power consumption)/(the original power consumption−the minimal power consumption)] Formula C First, when the original power consumption is more than the rated power consumption, the emitting time ratios Duty % are gotten by the following three images of the picture frame, whereby a process for making the power control look-up table can be gotten:

(1) When the image of the picture frame is white and has a gray-level value being 255, $W_{Gray255}=[R(640\times480\times255)+G(640\times480\times255)+B(640\times480\times255)]\approx235\times10^6$, wherein $W_{Gray255}$ is normalized, the display loading ratio=$[(235\times10^6)/(235\times10^6)]\times100\%=100\%$, the original power consumption (i.e., 100 W) is inputted to the Formula C so as to get Duty %=[(25 W−10 W)/(100 W−10 W)]×100%=16.67%;

(2) When the image of the picture frame is red and has a gray-level value being 255, $R_{Gray255}[R(640\times480\times255)+G(0\times0\times0)+B(0\times0\times0)]\approx78.35\times10^6$, wherein $R_{Gray255}$ is normalized, the display loading ratio=$[(78.3\times10^6)/(235\times10^6)]\times100\%=33.3\%$, the corresponding original power consumption is 40 W and inputted to the Formula C so as to get Duty %=[(25 W−10 W)/(40 W−10 W)]×100%=50%; and (3) When the image of the picture frame is yellow and has a gray-level value being 200, $Y_{Gray200}=[R(640\times480\times200)+G(640\times480\times200)+B(0\times0\times0)]\approx122.9\times10^6$, wherein $Y_{Gray200}$ is normalized, the display loading ratio=$[(122.9\times10^6)/(235\times10^6)]\times100\%=52.3\%$, the corresponding original power consumption is 57 W and inputted to the Formula C so as to get Duty %=[(25 W−10 W)/(57 W−10 W)]×100%=31.9%.

In other words, according the above-mentioned calculation, an original power consumption and a display loading ratio can be calculated according to an image signal; and when the original power consumption is more than the rated power consumption, the emitting time ratio Duty % can be gotten by dividing the amount difference between the rated power consumption and the minimal consumption value by the amount difference between the original power consumption and the minimal consumption value, i.e., [(the rated power consumption)−(the minimal consumption value)]/[(the original power consumption)−(the minimal consumption value)].

Second, when the original power consumption is less than the rated power consumption, the emitting time ratios Duty % are gotten by the following one image of the picture frame, whereby a process for making the power control look-up table can be gotten:

(1) When the image of the picture frame is black and has a gray-level value being 0, $W_{Gray000}=[R(640\times480\times0)+G(640\times480\times0)+B(640\times480\times0)]\approx0$, wherein $W_{Gray000}$ is normalized, the display loading ratio $W_{Gray000}=0$ (the original power consumption is 10 W); and when the original power consumption is less than the rated power consumption (i.e., 25 W), the maximal emitting time ratio (i.e., Duty % is 100%) can be gotten.

In other words, an original power consumption and a display loading ratio can be calculated according to an image signal; and when the original power consumption is less than the rated power consumption, the emitting time ratio Duty % can be gotten to be 100%, i.e., the maximal emitting time ratio.

Figure 5:
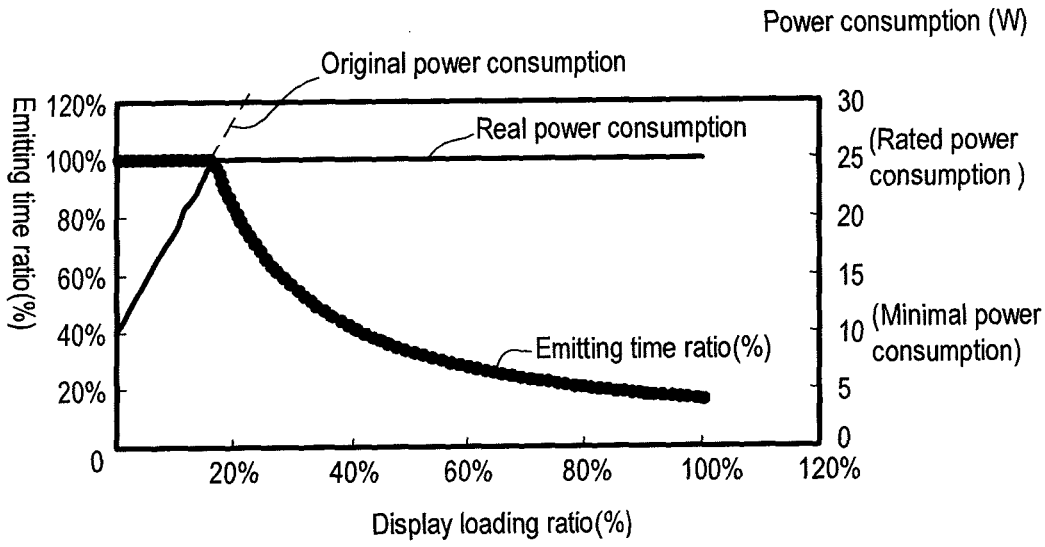
FIG. 5 a schematic view showing a relationship between the display loading ratios and the emitting time ratios, and a relationship between the display loading ratios and the power consumptions according to the embodiment of the present invention.

According the above-mentioned calculation, the corresponding emitting time ratios Duty % are calculated by different display loading ratios, and there is a relationship therebetween (as shown in FIG. 5).

Figure 6:
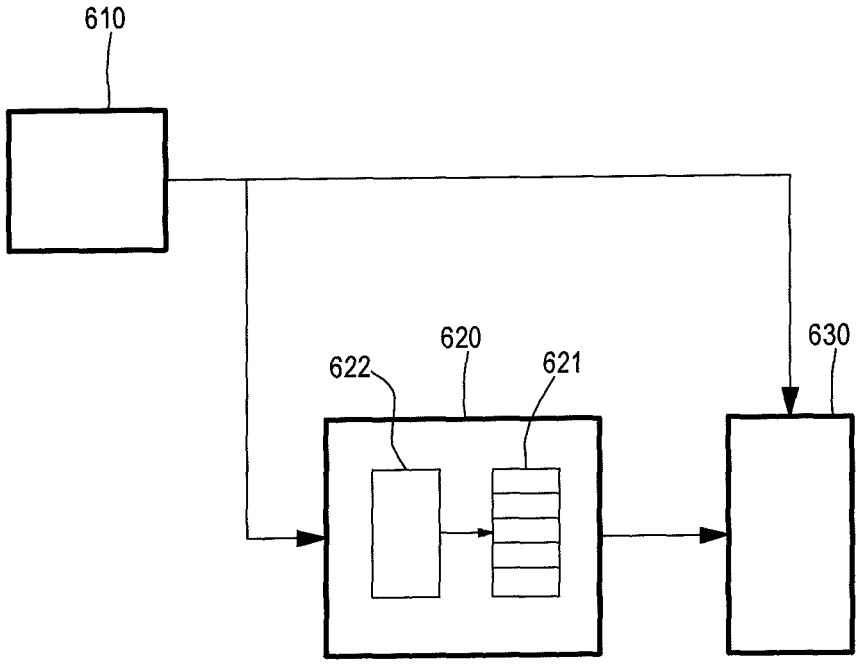
FIG. 6 is a block diagram showing a driving device of an OLED panel according to an embodiment of the present invention.

FIG. 6 is a block diagram showing a driving device of an OLED panel according to an embodiment of the present invention. Referring to FIGS. 6 and 5, the driving device is adapted to drive the OLED panel 630 and includes an image signal output unit 610 and a power control unit 620. The power control unit 620 includes a calculator 622 and a power control look-up table (LUT) 621. The power control look-up table 621 is the corresponding table of the relationship between the display loading ratios and the emitting time ratios shown as FIG. 5. The image signal output unit 610 is adapted to output the image signal. The power control unit 620 is electrically connected to the image signal output unit 610 for receiving the image signal, wherein the calculator 622 is adapted to calculate a display loading ratio according to the image signal. More detailed, the process for calculating the display loading ratio by the calculator 622 includes the following steps. The maximal gray-level values of all pixel regions are summed up so as to calculate a maximal display loading value. According the image signal, the gray-level values of all pixel regions are summed up so as to calculate a display loading value. The display loading value is divided by the maximal display loading value so as to get the display loading ratio.

According to the display loading ratio, the power control unit 620 can find an emitting time ratio by the power control look-up table 621 corresponding to the display loading ratio. The emitting time ratio can be transformed to an emitting time signal. The emitting time signal is inputted to the emitting control lines of the OLED panel 630 so as to control the power consumption of the OLED panel 630. In other words, the OLED panel 630 is electrically connected to the power control unit 620 for receiving the emitting time ratio. The emitting time ratio is a ratio of the real emitting time to the maximal emitting time. The OLED panel 630 can transform the emitting time ratio to the emitting time signal, whereby the OLED panel 630 can be lighted, and the emitting time of the OLED panel 630 can be certain. The OLED panel 630 is also electrically connected to the image signal output unit 610 for receiving the image signal so as to show the gray-level value of the image.

Figure 7:
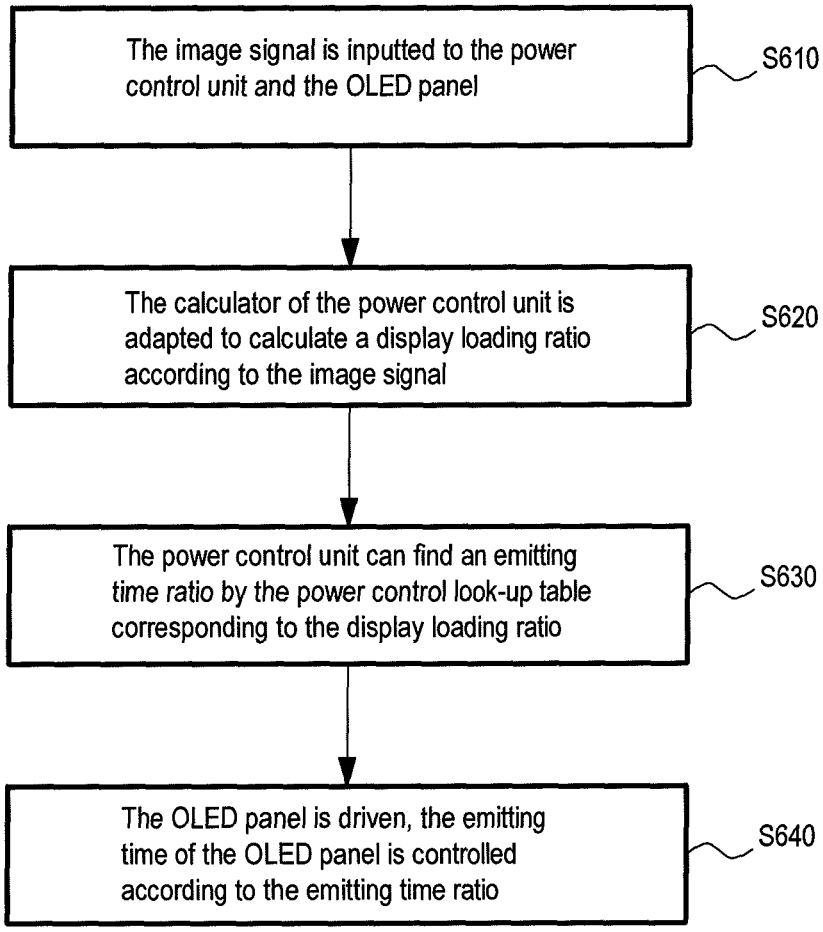
FIG. 7 is flow diagram of a method for driving an OLED panel according to the embodiment of the present invention.

FIG. 7 is flow diagram of a method for driving an OLED panel according to the embodiment of the present invention. Referring to FIGS. 7 and 6, in the step S610, the image signal 610 is inputted to the power control unit 620 and the OLED panel 630. In the step S620, the calculator 622 of the power control unit 620 is adapted to calculate a display loading ratio according to the image signal. In the step S630, the power control unit 620 can find an emitting time ratio Duty % by the power control look-up table 621 corresponding to the display loading ratio, the emitting time ratio can be transformed to an emitting time signal, and the emitting time signal is inputted to the emitting control lines of the OLED panel 630. In the step S640, the OLED panel 630 is driven, the emitting time of the OLED panel 630 is controlled according to the emitting time ratio Duty % so as to control the power consumption of the OLED panel 630.

Thus, the present invention utilizes the emitting control lines to control the emitting time of the OLED panel, and then control the power consumption so as to improve the lifetime of the OLED panel and to keep the resolution of the same gray-level. The present invention can indirectly improve the quality of motion blur image, and has no problem of the dither noise and the flash of frame rate control (FRC) in the prior art.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method for driving an organic light emitting diode (OLED) panel comprising the following steps of:

inputting an image signal to a power control unit, wherein the power control unit comprises a calculator and a power control look-up table;

calculating a display loading ratio by the calculator according to the image signal;

finding an emitting time ratio by the power control look-up table of the power control unit corresponding to the display loading ratio;

transforming the emitting time ratio to an emitting time signal; and inputting the emitting time signal to the OLED panel so as to control the power consumption of the OLED;

wherein the step for calculating the display loading ratio by the calculator further comprises the following steps of:

summing up maximal gray-level values of all pixel regions so as to calculate a maximal display loading value;

summing up the gray-level values of all pixel regions according the image signal, so as to calculate a display loading value; and dividing the display loading value by the maximal display loading value so as to get the display loading ratio.

2. The method as claimed in claim 1, wherein the power control look-up table is a corresponding table of the relationship between display loading ratios and emitting time ratios.

3. The method as claimed in claim 1, wherein a process for making the power control look-up table further comprises the following steps of:

calculating a first original power consumption and a first display loading ratio according to a first image signal; and getting the emitting time ratio by dividing the amount difference between the rated power consumption and the minimal consumption value by the amount difference between the original power consumption and the minimal consumption value, when the first original power consumption is more than a rated power consumption.

4. The method as claimed in claim 1, wherein a process for making the power control look-up table further comprises the following steps of:

calculating a second original power consumption and a second display loading ratio according to a second image signal; and getting the emitting time ratio to be 100%, when the second original power consumption is less than a rated power consumption.

5. The method as claimed in claim 4, wherein the emitting time ratio is a maximal emitting time ratio.

6. The method as claimed in claim 1, wherein the emitting time ratio is a ratio of a real emitting time to a maximal emitting time.

7. A driving device of an OLED panel, the OLED panel comprising a plurality of emitting control lines for controlling an emitting time of the OLED panel, the driving device comprising:

an image signal output unit adapted to output the image signal; and a power control unit electrically connected to the image signal output unit for receiving the image signal, wherein the power control unit comprises a calculator and a power control look-up table, the calculator is adapted to calculate a display loading ratio according to the image signal, the power control unit finds an emitting time ratio by the power control look-up table corresponding to the display loading ratio, the emitting time ratio is transformed to an emitting time signal, and the emitting time signal is inputted to the emitting control lines of the OLED panel so as to control the power consumption of the OLED panel;

wherein the display loading ratio is defined as follows:

maximal gray-level values of all pixel regions are summed up, so as to calculate a maximal display loading value;

the gray-level values of all pixel regions are summed up according the image signal, so as to calculate a display loading value; and the display loading value is divided by the maximal display loading value, so as to get the display loading ratio.

8. The driving device of the OLED panel as claimed in claim 7, wherein the power control look-up table is a corresponding table of the relationship between display loading ratios and emitting time ratios.

9. The driving device of the OLED panel as claimed in claim 7, wherein the emitting time ratio is a ratio of a real emitting time to a maximal emitting time.

* * * * *